United States Patent [19]

LeVine

[11] Patent Number: 4,777,770

[45] Date of Patent: Oct. 18, 1988

[54] KNIFE SHARPENER

[76] Inventor: Arthur L. LeVine, P.O. Box 800, Williamsville, N.Y. 14221

[21] Appl. No.: 518,051

[22] Filed: Jul. 28, 1983

Related U.S. Application Data

[62] Division of Ser. No. 325,757, Nov. 30, 1981, abandoned.

[51] Int. Cl.[4] ..... B24D 15/08

[52] U.S. Cl. ..... 51/205 R; 51/57; 51/392; 51/205 WG; 76/88

[58] Field of Search ..... 51/57, 204, 205 R, 205 WG, 51/391-393, 211 R, 211 H, DIG. 21; 76/82.2, 82, 88; 269/1-3, 6, 87-87.3; 403/362; 16/DIG. 12, 19

[56] References Cited

U.S. PATENT DOCUMENTS

| | | | |
|---|---|---|---|
| 308,046 | 11/1884 | Williams . | |
| 905,331 | 12/1908 | Larsen et al. . | |
| 1,148,303 | 7/1915 | Farrar . | |
| 1,368,218 | 2/1921 | Chenette . | |
| 1,431,612 | 10/1922 | Wittner | 403/362 |
| 1,832,968 | 11/1931 | De Armey . | |
| 1,896,946 | 2/1933 | Gauss | 51/205 R |
| 2,009,222 | 7/1935 | Connor | 51/204 |
| 2,012,513 | 8/1935 | Maze . | |
| 2,116,343 | 5/1938 | Davis . | |
| 2,157,816 | 5/1939 | Carosi . | |
| 2,280,767 | 4/1942 | Ferragano | 51/205 R |
| 3,733,933 | 5/1973 | Longbrake . | |
| 3,819,170 | 6/1974 | Longbrake | 76/88 |
| 4,137,670 | 2/1979 | Goraski | 51/392 |
| 4,170,343 | 10/1979 | Longbrake . | |
| 4,320,892 | 3/1982 | Longbrake . | |

FOREIGN PATENT DOCUMENTS

| | | | |
|---|---|---|---|
| 0201556 | 4/1956 | Australia | 51/57 |
| 0153015 | 4/1938 | Fed. Rep. of Germany | 403/362 |
| 0125167 | 4/1928 | Switzerland | 51/392 |
| 0290835 | 5/1928 | United Kingdom | 403/362 |

*Primary Examiner*—Robert P. Olszewski
*Attorney, Agent, or Firm*—Joseph P. Gastel

[57] ABSTRACT

A sharpener construction including a sharpener stone holder having an elongated body portion and a surface for receiving a sharpener stone with a plurality of concave depressions extending transversely to the stone receiving surface for receiving the fingers of a person, a screw attachment at the end of the elongated body portion for adjustably receiving the end of a guide rod which in turn is slidably received in preselected oval apertures in upstanding guides attached to the sharpener.

5 Claims, 2 Drawing Sheets

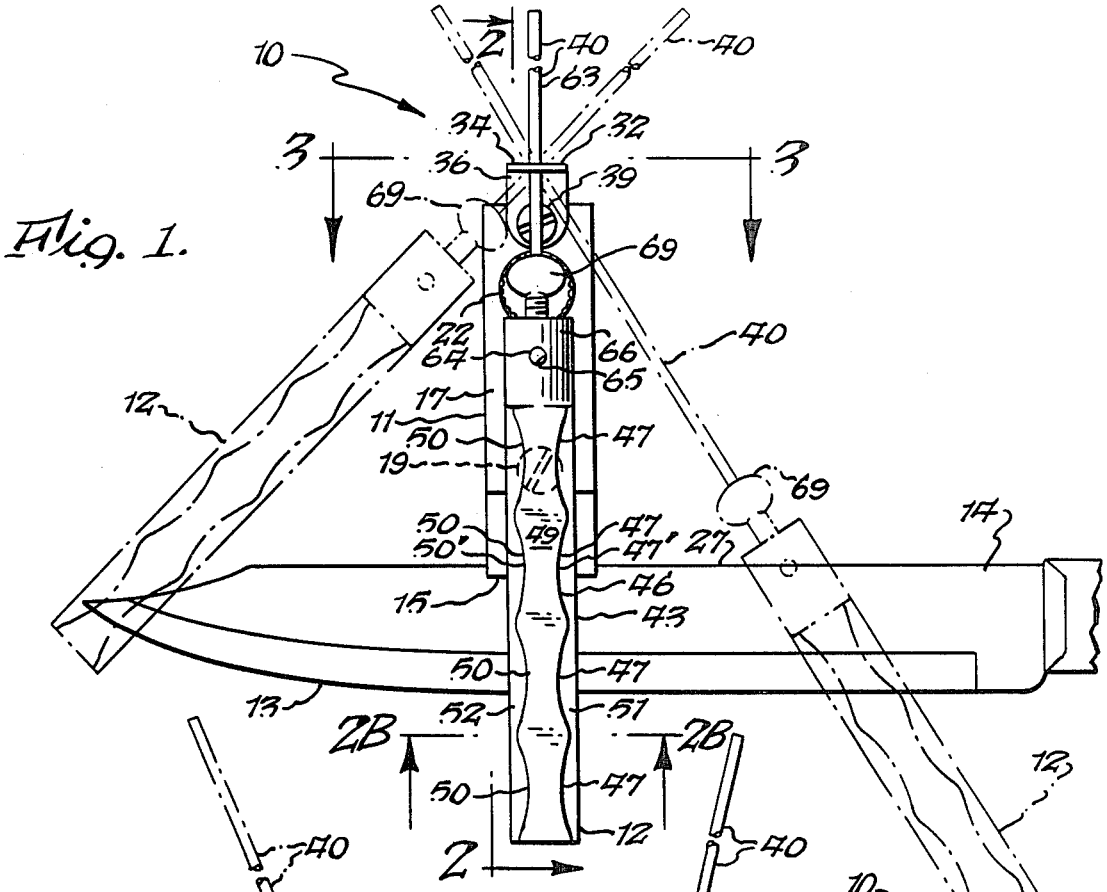
Fig. 1.
10
2
40
63
34
32
36
39
3
69
22
64
66
65
17
11
50
47
19
12
14
27
15
46
43
13
52
51
2B
50'
47'
49
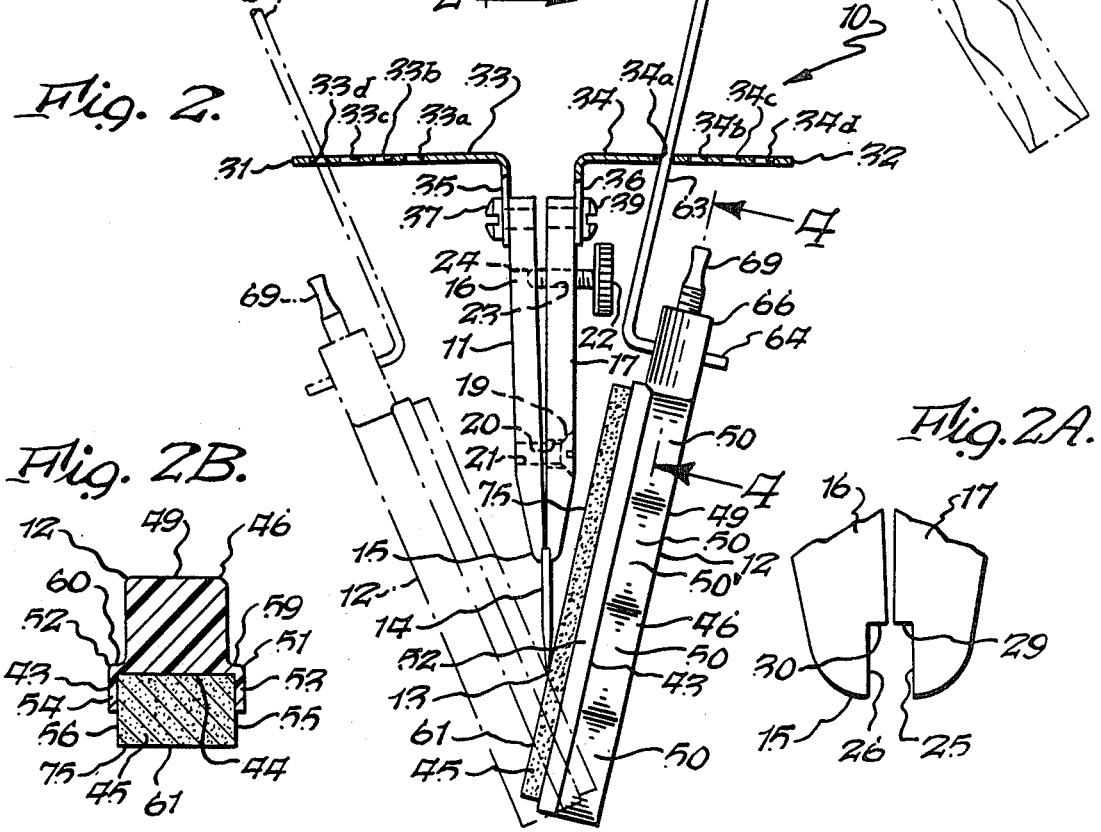
Fig. 2.
Fig. 2A.
Fig. 2B.
10
33d
33b
33
33c
33a
34
34a
34c
34b
34d
31
32
35
36
37
39
63
4
24
16
23
69
66
64
11
22
17
19
20
21
75
50
49
12
14
52
13
61
45
46
43
30
29
15
26
25
44
54
56
55
53
59
60

Fig. 3.
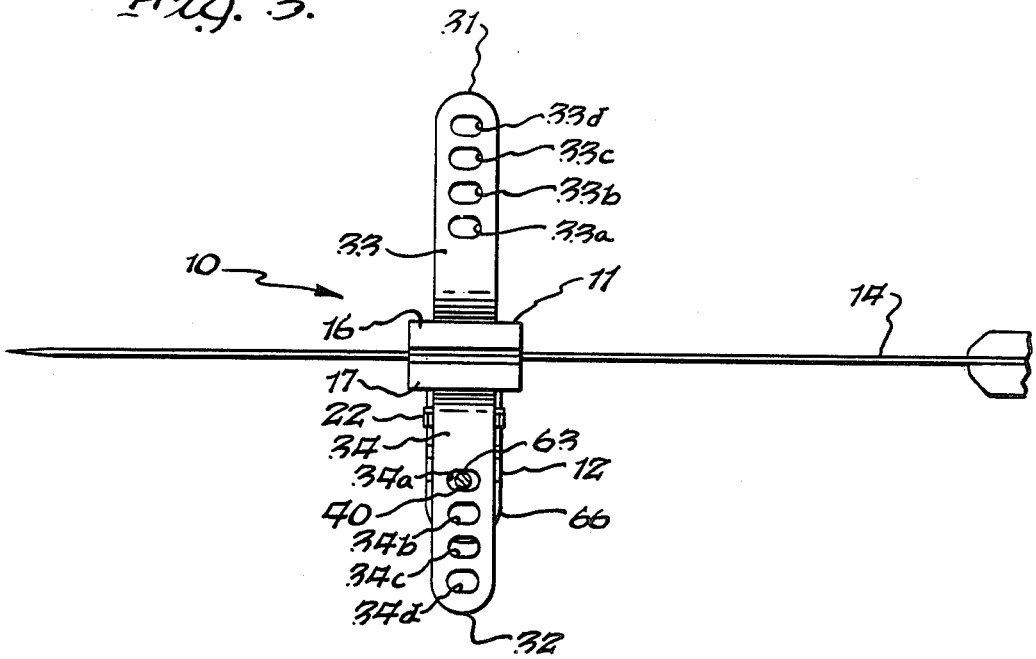
Fig. 4.
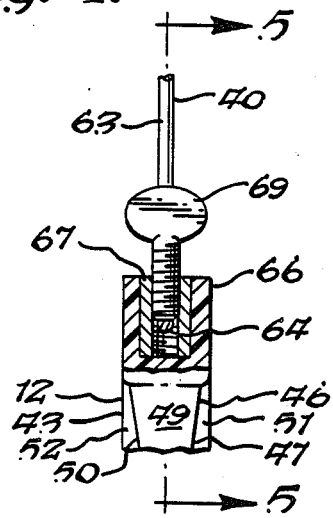
Fig. 5.
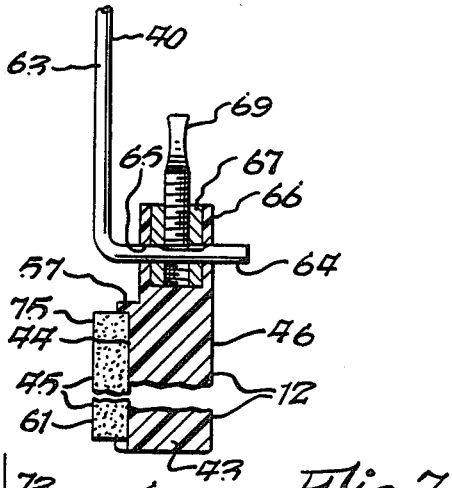
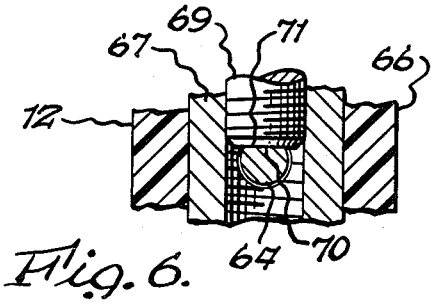
Fig. 6.
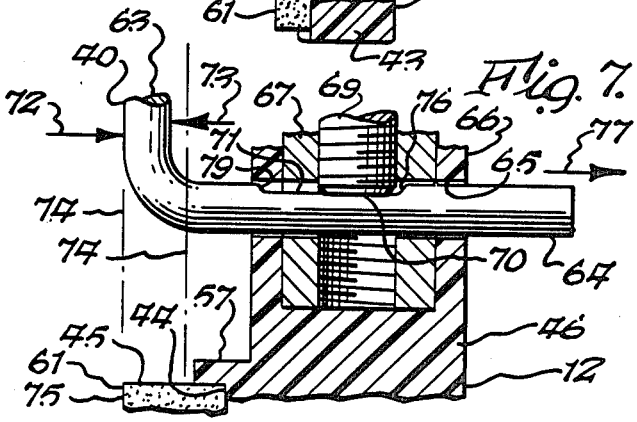
Fig. 7.

KNIFE SHARPENER

This is a division of application Ser. No. 325,757 filed Nov. 30, 1981, now abandoned.

BACKGROUND OF THE INVENTION

The present invention relates to an improved knife sharpener.

By way of background, sharpeners of the type shown in U.S. Pat. No. 3,819,170 are known. In sharpeners of this type, a knife blade is clamped between two clamp members and a sharpening stone is guided along the edge of a blade by a rod member secured to a sharpener stone holder and guided through an aperture in an upstanding guide. However, the prior device was subject to certain deficiencies. The first deficiency was that the hole through which the rod was guided was circular, thereby limiting the lateral sweep of the stone across the knife edge. Another deficiency was in the sharpener stone holder itself. Firstly, the manner in which the holder was held could result in cutting of the fingers because the fingers usually extended beyond the lower surface of the stone which contacted the knife edge. Secondly, the holder was held in an awkward position by only two fingers, thereby providing less control than if the holder was held with all of the fingers. Thirdly, the fingers produced more of a pushing motion of the stone toward the blade than a downward motion causing the stone to bear against the edge of the blade, which in turn was more likely to result in an uneven sharpening. It is with overcoming the foregoing deficiencies of prior art types of devices that the present invention is concerned.

SUMMARY OF THE INVENTION

It is accordingly one object of the present invention to provide an improved knife sharpener in which relatively long blades can be sharpened because of the fact that the knife sharpener stone is capable of being moved in a relatively large lateral sweep lengthwise of the blade.

Another object of the present invention is to provide an improved sharpener stone holder for a sharpener which is securely grasped by all five fingers to provide extremely good control during a knife sharpening operation.

A further object of the present invention is to provide an improved sharpener stone holder which possesses a protective flange between the fingers and the sharpener stone to tend to prevent overhang of fingers which could be injured by the knife edge being sharpened.

A still further object of the present invention is to provide an improved sharpener stone holder which can be grasped with equal facility by either the right or the left hand and which will provide all of the advantages in either event.

Yet another object of the present invention is to provide a sharpener stone holder gauging construction which effects automatic alignment between the sharpener stone holder guide and the stone when the stone is new and which permits adjustment as the stone wears and which automatically indicates when the stone has worn to the point at which it should be replaced. Other objects and attendant advantages of the present invention will readily be perceived hereafter.

The present invention relates to a sharpener stone holder comprising an elongated body portion having a longitudinal axis and first surface means extending lengthwise of the body portion for mounting a sharpener stone, a plurality of concave second surface means extending transversely to said first surface means for receiving the fingers of a person, and attachment means on said elongated body for mounting an elongated rod extending lengthwise of said body portion. The sharpener stone holder of the present invention also includes flange means proximate the juncture of the first and second surface means extending transversely to said second surface means for the purpose of protecting the fingers against overhanging to the extent they could be cut by the knife edge being sharpened.

The present invention also relates to a sharpener stone holder comprising an elongated body portion having a longitudinal axis and surface means for mounting a sharpener stone extending lengthwise of said longitudinal axis, a bore at one end of said elongated body portion extending transversely to said longituidnal axis, an elongated rod having a main portion and an end portion extending transversely to said main portion and being located in said bore, a flat on said end portion, a screw threadably mounted on said end portion transversely to and intersecting with said bore for bearing on said flat, and shoulder means at the end of said flat for defining the limit of movement of said end portion in said bore by abutting said screw.

The present invention also relates to a sharpener construction comprising a pair of clamp members having a first longitudinal axis and first and second ends, a pair of jaws at said first end for clamping the rear edge of a knife with a second longitudinal axis extending transversely to said first longitudinal axis, guide member means extending outwardly from said clamp members at said second end, a plurality of apertures in said guide member means at different distances from said second end for receiving a guide rod attached to a sharpener stone holder, said apertures being oval in shape to allow for a relatively large lateral sweep of said guide rod.

The various aspects of the present invention will be more fully understood when the following portions of the specification are read in conjunction with the accompanying drawings wherein:

BRIEF DESCRIPTION OF THE DRAWINGS

FIG. 1 is a fragmentary plan view of the improved knife sharpener of the present invention mounting a knife to be sharpened and showing the sharpening stone holder in a plurality of positions;

FIG. 2 is a side elevational view taken substantially in the direction of arrows 2—2 of FIG. 1 and showing the sharpener stone holder in solid lines for sharpening one side of the blade edge and showing it in phantom lines for sharpening the other side of the blade edge;

FIG. 2A is a fragmentary enlarged view of the clamp end of the sharpener;

FIG. 2B is a cross sectional view taken subtantially along line 2B—2B of FIG. 1;

FIG. 3 is a fragmentary end elevational view taken substantially in the direction of arrows 3—3 of FIG. 1 and showing the oval holes for receiving the sharpener stone guide rod;

FIG. 4 is a fragmentary cross sectional view taken substantially along line 4—4 of FIG. 2 and showing the construction at the end of the sharpener stone holder for securing the guide rod therein;

FIG. 5 is a fragmentary cross sectional view taken substantially along line 513 5 of FIG. 4;

FIG. 6 is a fragmentary enlarged view of a portion of FIG. 4; and

FIG. 7 is a fragmentary enlarged view of a portion of FIG. 5.

DESCRIPITON OF THE PREFERRED EMBODIMENTS

The sharpener 10 includes a knife clamp 11 and a sharpener stone holder 12 which is operative therewith to sharpen the edge 13 of a knife 14 which is held between jaws 15. Clamp 11 includes two clamp members 16 and 17 which are secured to each other by means of a screw 19 which extends through an aperture 20 in clamp member 17 and is threadably received in tapped bore 21 of clamp member 16. A thumb screw 22 is threadably received in tapped bore 23 of clamp member 17 and the end of thumb screw 22 bears against the surface of clamp member 16 and is received in dimple or complementary depression 24 to prevent sidewise movement of clamp members 16 and 17 relative to each other.

In order to secure a knife 14 within jaws 15 of clamp 11, screw 19 is backed off sufficiently so that the distance between surfaces 25 and 26 of jaws 15 receives the rear edge portion 27 of blade 14 with a reasonably tight fit, and thereafter thumb screw 22 is manipulatd to force clamp members 16 and 17 away from each other in the area of thumb screw 22 so that the jaws 15 will tightly clamp the rear edge 27 of knife 14 therebetween. The very outer edge portion of edge 27 will rest against surfaces 29 and 30 of jaws 15.

A pair of guide members 31 and 32 extend upwardly from clamp members 16 and 17, respectively. Guide members are fabricated from bent sheet metal and include upstanding main portions 33 and 34, respectively, and foot portions 35 and 36, respectively, which extend substantially perpendicularly to the main portions and are formed integrally therewith. Screws 37 and 39 extend through apertures in foot portions 35 and 36, respectively, and are threadably received in clamp members 16 and 17, respectively, to thereby secure the guide members 31 and 32 to the clamp members.

A sharpener stone holder 12 includes an elongated body portion 43 which is fabricated from molded plastic. It includes a planar surface 44 extending substantially throughout the length of holder 12, and to which a sharpener stone 45 is adhesively secured. A finger grip portion 46 forms a part of body portion 43 and it includes a plurality of concave indentations 47 on one side of ridge 49 and a symmetrical group of concave deformations 50 on the other side of ridge 49. In essence therefore concave deformations 47 and 50 define wave-like surfaces. A right-handed person would therefore place his four fingers in concavities 47 and his thumb in the concavity which is also designated 50'. A left-handed person would place his four fingers in concavities 50 and his thumb in concavity which is also designated 47'. Therefore, the sharpener stone holder 12 can be manipulated with equal facility by a right-handed or a left-handed person.

Flanges 51 and 52 are molded integrally with ridge 49 and include the symmetrical downwardly extending side portions 53 and 54, respectively, which bracket the sides 55 and 56 of stone 45. In addition, a downwardly extending flange 57 (FIGS. 5 and 7) is located at one end of holder 12, as shown. The upper portions 59 and 60 of flanges 51 and 52, respectively, comprise shelves which serve as stops for the ends of a person's fingers and thumb, thereby preventing them from extending outwardly beyond the lower surface 61 of stone 45 where the fingers might engage the edge 13 of knife 14.

The sharpener stone holder 12 mounts a guide rod 40 at one end. Guide rod 40 includes a main guide portion 63 and an attachment portion 64 which extends at substantially right angles thereto and which is received in a bore 65 in the end portion 66 of holder 12. A tapped metal insert 67 is embedded in end 66 for receiving thumb screw 69. Attachment portion 64 is inserted through bore 65, as shown in FIGS. 5 and 7, and thumb screw 69 is tightened so that the end 70 thereof bears against flat 71 of attachment portion 64 to hold guide rod 40 in position.

The adjustment of guide rod portion 63 in the direction of arrows 72 and 73 is effected by moving attachment portion 64 in the direction of these arrows and thereafter tightening thumb screw 69. The ultimate objective is to have the edge of guide portion 63, as denoted by numeral 74, substantially in line with the surface 75 of stone 45. When the stone is initially installed in the holder 12, surfaces 74 and 75 will be in substantial alignment when shoulder 76 at the end of flat 71 is brought into abutting engagement with the end of thumb screw 69. As the stone wears, the attachment portion 64 will be moved gradually in the direction of arrow 77 as the edge 74 is kept in alignment with the worn surface 75. However, a point will be reached where surface 74 reaches the dotted line position shown in FIG. 7 at which time shoulder 79 at the end of flat 71 will abut the end of thumb screw 69, thereby providing an indication that stone 45 has worn to the extent that it should be replaced by either removing it from holder 12 or replacing it with another holder-stone combination.

A plurality of oval apertures 33*a–d* are provided in guide 31 and a plurality of oval apertures 34*a–d* are provided in guide 32. Rod portion 63 of rod 40 is inserted through a preselected aperture, for example, aperture 34*a*, as shown in FIG. 3, and the holder 12 is grasped in the above described manner and the stone 45 is moved transversely and longitudinally of edge 13 to sharpen it while the angle between the edge 75 of the stone and the edge 13 of the blade is maintained constant because rod 63 is guided by the aperture in which it is located. The desired angle to be placed on edge 13 is selected by selecting which of the apertures in guides 31 and 32 is to be used. In use, first one side of edge 13 is sharpened by causing guide rod 40 to xxtend through one of the holes in one of the guides 31 or 32 and thereafter the other side of edge 13 is sharpened by causing rod 40 to extend through a corresponding aperture in the other of guides 31 or 32.

While preferred embodiments of the present invention have been disclosed, it will be appreciated that the present invention is not limited thereto, but may be otherwise embodied within the scope of the following claims.

What is claimed is:

1. A sharpener stone and holder comprising an elongated body portion having a longitudinal axis, surface means on said elongated body portion, a sharpener stone mounted on said surface means and extending lengthwise of said longitudinal axis, a sharpening surface on said sharpener stone, a bore at one end of said elongated body portion extending transversely to said longitudinal axis, an elongated rod having a main portion and an end portion extending transversely to said main portion and being located in said bore, a flat on said send portion, a screw threadably mounted on said elongated body portion and extending transversely to and intersecting with said bore for bearing on said flat, said flat permitting said main portion to be aligned with said sharpening surface as the latter wears while said screw maintains a bearing relationship with said flat, and shoulder means at the end of said flat for defining the limit of movement of said end portion in said bore by abutting said screw, to thereby indicate that said sharpening surface has worn to the extent that it should be replaced.

2. A sharpener stone holder as set forth in claim 1 wherein said shoulder means comprises first and second shoulders at the end of said flat.

3. A sharper stone and holder comprising an elongaed body portion having a longitudinal axis and elongated planar first surface means extending lengthwise of the body portion, a sharpener stone mounted on said first surface means, second and third surface means on the outer sides of said elongated body portion extenidng in a direction transverse to said elongated planar first surface means, first and second concave indentation means in said second and third surface means, respectively, said first and second concave indentation means defining wave-like patterns extending longitudinally of said elongated body portion for receiving the finger tips of a person on said second surface means and for receiving the end of the thumb of a person on said third surface means, attachment means on said elongated body for mounting an elongaed rod extending lengthwise of said body portions, said shapener stone including a sharpening surface, said attachment means comprising a bore extending transversely to said longitudinal axis proximate the end of said elongated body portion, an elongated rod having a main portion and an end portion extending transvesely to said main portion and being located in said bore, a flat on said end portion, a screw threadably mounted on said end portion transversely to and intersecting with said bore for bearing on said flat, said flat permitting said main portion to be aligned with said sharpening surface as the latter wers while said screw maintains a bearing relationship with said flat, and shoulder means at the end of said flat for defining the limit of movement of said end portion in said bore by abutting said screw, to thereby indicate that said sharpening surface has worn to the extent that it should be replaced.

4. A sharpener stone and holder comprising an elongated body portion having a longitudinal axis and elongated planar first surface means extending lengthwise of the body portion, a sharpener stone mounted on said first surface means, second and third surface means on the outer sides of said elongated body portion extending in a direction transverse to said elongated planar first surface means, first and second concave indentation means in said second and third surface means, respectively, said first and second concave indentation means defining wave-like patterns extending longitudinally of said elongated body portion for receiving the finger tips of a person on said second surface means and for receiving the end of the thumb of a person on said third surface means, attachment means on said elongated body for mounting an elongated rod extending lengthwise of said body portion, first and second flange means on opposite sides of said elongated body portion and proximate the juncture of said first surface means with said second and third surface means, respectively, and extending outwardly from said second and third surface means for serving as stops for said ends of said finger tips and said end of said thumb, respectively, said sharpener stone being located to one side of said first and second flange means and said second and third surface means being located on the opposite side of said first an second flange means from said sharpener stone, said first and second flange means preventing said ends of asid fingers and said end of said thumb from extending outwardly beyond said sharpener stone.

5. A sharpener stone and holder as set forth in claim 4 wherein said sharpener stone includes opposite sides, and first and second side portions extending downwardly from said first and second flange means for engaging said opposite sides of said sharpener stone.

* * * * *

UNITED STATES PATENT AND TRADEMARK OFFICE

CERTIFICATE OF CORRECTION

PATENT NO. : 4,777,770

DATED : October 18, 1988

INVENTOR(S) : Arthur L. LeVine

It is certified that error appears in the above-identified patent and that said Letters Patent is hereby corrected as shown below:

Column 3, line 2, change "5135" to --5-5--.

Column 4, line 50, change "xxtend" to --extend--.

Column 5, line 3 (claim 1), change "send" to --end--.

Column 5, line 17 (claim 3), change "elongaed" to --elongated--;
line 22 (claim 3), change "extenidng" to --extending--;
line 32 (claim 3), change "elongaed" to --elongated--;
line 38 (claim 3), change "transvesely" to --transversely--;
line 43 (claim 3), change "wers" to --wears--.

Column 6, line 33 (claim 4), change "an" to --and--;
line 36 (claim 4), change "asid" to --said--.

Signed and Sealed this

Twenty-eighth Day of February, 1989

*Attest:*

DONALD J. QUIGG

*Attesting Officer*

*Commissioner of Patents and Trademarks*